United States Patent [19]

Cielo et al.

[11] 4,275,290

[45] Jun. 23, 1981

[54] THERMALLY ACTIVATED LIQUID INK PRINTING

[75] Inventors: Paolo Cielo, Dartmouth; William D. Westwood, Nepean, both of Canada

[73] Assignee: Northern Telecom Limited, Montreal, Canada

[21] Appl. No.: 48,670

[22] Filed: Jun. 14, 1979

Related U.S. Application Data

[63] Continuation-in-part of Ser. No. 903,516, May 8, 1978, abandoned.

[51] Int. Cl.[3] ..... H05B 1/00

[52] U.S. Cl. ..... 219/216; 346/140 R

[58] Field of Search ..... 219/216; 346/75, 140 R; 250/317-319; 101/1, 426; 96/1 A

[56] References Cited

U.S. PATENT DOCUMENTS

| | | | |
|---|---|---|---|
| 2,071,967 | 2/1937 | Bungner | 346/140 |
| 2,151,638 | 3/1939 | Genschmer | 346/140 |
| 3,177,800 | 4/1965 | Welsh | 346/140 X |
| 3,179,042 | 4/1965 | Naiman | 346/140 X |
| 3,211,088 | 10/1965 | Naiman | 101/1 X |
| 3,790,703 | 2/1974 | Carley | 346/140 X |
| 3,834,301 | 9/1974 | Croquelois et al. | 101/426 |
| 3,996,883 | 12/1976 | Gusarov et al. | 346/33 F X |
| 4,023,180 | 5/1977 | Zenner | 346/140 |

*Primary Examiner*—C. L. Albritton
*Attorney, Agent, or Firm*—Sidney T. Jelly

[57] ABSTRACT

A thermally activated liquid ink printing head has a plurality of orifices in a wall of an ink reservoir, the ink retained in the orifices by surface tension. Electrical heating elements heat the ink in the orifices, the ink being caused to pass across to a paper sheet positioned adjacent to the orifices. The orifices may extend in a line across the head or may be in other predetermined patterns, such as for printing alpha-numerics a character at a time. The ink may be completely or partly vaporized. The heating current may flow through the ink.

5 Claims, 4 Drawing Figures

THERMALLY ACTIVATED LIQUID INK PRINTING

This application is a continuation-in-part of application Ser. No. 903,516, filed May 8, 1978, abandoned.

This invention relates to thermally activated liquid ink printing, and in particular to the control of the amount of ink, or other liquid tones, transferred to the paper.

The control is achieved by the application of a localized electric current to cause at least partial vapourization of the ink and/or reduction in the surface tension. The formation of gas bubbles following the electric heating of a resistor in contact with ink, or chemical reactions associated with ion conduction through ink, provide the required pressure to transfer an ink drop to the paper. The reduction of surface tension provides for transfer of an ink drop to the paper. The invention is particularly applicable to facsimile printing.

Various techniques exist for facsimile and other printing, such as impact, thermal and ink ejection.

Impact techniques require the mechanical displacement of a hammer which transfers ink from a ribbon to the paper to record the desired information. The main problems of these techniques are limited life and reliability of moving parts, noise, low speed, high power consumption and cost. With the present invention, there are no moving parts for the printing head and high speed, low noise and improved power consumption are obtained.

Thermal printing consists in localized heating of a precoated heat sensitive paper. Heat is usually supplied by an electric current through thin or thick film resistors in contact with paper. With the present invention there is no need for pre-coated paper. Moreover, inks of different colours can be handled.

Ink jet printing comprises the ejection from an ink reservoir and subsequent deflection of ink droplets. The undeflected drops strike a paper sheet and form the desired pattern. Most droplets are however deflected to a gutter from which ink is returned to the reservoir through a recirculating and filtering system. This technique is bulky and complex owing to the hydraulic recirculating system, and hardly reliable because of the presence of high pressure ink containers and ink fog generated at the impact of ink with paper. With the present invention there is no continuous ink-jet, so that the recirculation system is not required and there is no high pressure impact of ink with paper. The system is more compact, and the production of ink fog is avoided.

Broadly, the present invention applies heat locally to the ink in an orifice whereby the ink is caused to transfer across a gap to the paper. The heat either at least partially vapourizes the ink, the formation of gas bubbles causing the ink to move out of the orifice, or the surface tension of the ink is reduced, again causing the ink to move out of the orifice. A combination of these effects can also occur. The term ink as used hereinafter is intended to include any liquid toner which can be caused to transfer by the heating, either by the vapourizing or reduction in surface tension and will produce a coloured spot or lines or other on the paper or other material.

The invention will be readily understood by the following description of certain embodiments, by way of example, in conjunction with the accompanying drawings, in which.

Figure 1:
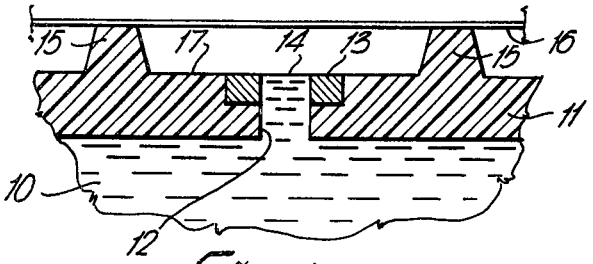
FIG. 1 is a cross-section through part of a printing head, illustrating one general form of the invention.
Figure 2:
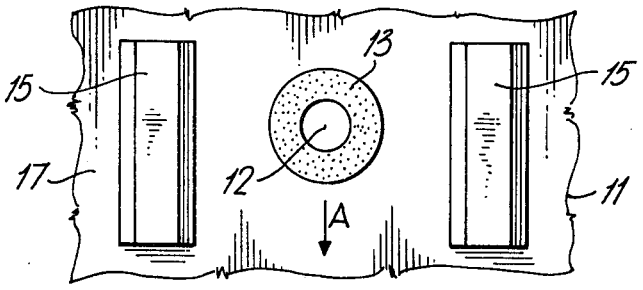
FIG. 2 is a top plan view of the arrangement of FIG. 1, with the paper removed.

As illustrated in FIGS. 1 and 2, ink, indicated at 10, is contained in a reservoir, the wall of which is indicated at 11. In the wall is an orifice 12. Around the orifice 12 is a resistor heating element 13. In practice a plurality of orifices 12 are provided as described in relation to FIG. 3. The ink 10 fills the orifice 12 under capilliary action but is held in the orifice by surface tension at the surface 14. On either side of the orifice are spacers 15 on which rests the paper 16. The paper moves in the direction of arrow A in FIG. 2. The orifices 12 can be circular, rectangular or other shape. The spacers are preferably elongate, as in FIG. 2 and extend beyond the orifice to assist in preventing ink adhesion on the reservoir surface 17.

Operation is as follows. An electrical current pulse heats up the resistor 13 surrounding the orifice 12 and vapourizes the nonconductive ink in the orifice up to the paper sheet 16. The vapour condenses on the paper and causes a dark, or coloured, spot. After the pulse the orifice 12 refills with ink by capilliary action. A small hydrostatic pressure, less than the surface tension on the ink surface 14, can be applied to the ink in the reservoir to speed up the ink restoration into the orifice.

The ink may be completely or partially vapourized. When only partially vapourized the ink is transported by a force provided by pressure exerted on the surrounding liquid by vapour bubbles created by the heating of the resistor 13.

Figure 3:
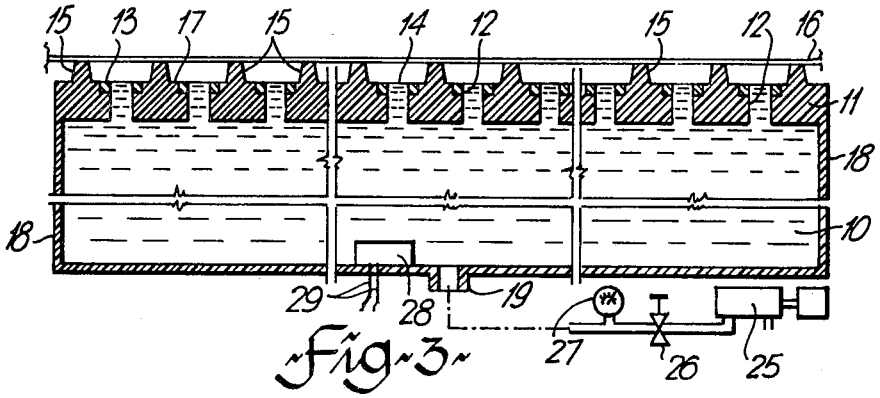
FIG. 3 is a transverse cross-section through one form of printing head.

FIG. 3 illustrates, in cross-section along a line or orifices, that is in a plane coincident with a printing line, one form of printing head. The reservoir is illustrated at 18, the remaining items having the same references as in FIGS. 1 and 2. An ink supply conduit is indicated at 19, to which ink is fed from a supply pump 25, which can also create any required hydrostatic pressure in the reservoir, the pressure being controlled by a control valve 26, the pressure indicated on meter 27.

The hydrostatic pressure in the reservoir is set, by the valve 26, to be such that the ink is caused to flow into the orifices 12 to the outer ends of the orifices but is retained at the outer ends by surface tension. This pressure is directly related to the orifice cross-sectional dimensions and the viscosity of the ink and is readily determined. The hydrostatic pressure in the ink can be varied such that, while the ink extends to the outer ends of the orifices, the radius of curvature of the miniscus formed at the outer end of each orifice can be varied. There is a range of hydrostatic pressure over which ink will reach the outer ends of the orifices but be retained by surface tension.

The printing head illustrated in FIG. 3 can be manufactured, as an example, by preferentially etching a hole array through a silicon wafer followed by a localized doping of the inside hole surface to provide a surface resistor of the required resistivity in contact with the ink, at each hole.

Figure 4:
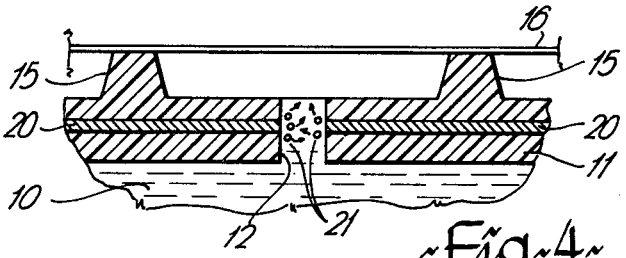
FIG. 4 is a similar cross-section to that of FIG. 1, illustrating a modification thereof.

A variation in the above is to heat the ink by an electric current flowing directly through the ink. In this configuration, the ink should be made slightly conductive, for example by adding some NaCl salt to acqueous ink. FIG. 4 illustrates one arrangement of this method. The electric current is carried by electrodes 20, which are in contact with the ink 10 but do not surround the slot. The electrodes could be manufactured for example by thin film techniques. The wall 11 being built up by layers, with the electrodes 20 between two layers. The electric current is forced to flow through the ink, and if its chemical composition is suitably chosen, gaseous chemical products are generated at the electrodes surfaces in contact with ink, as a result of electrochemical reactions. A simple example is the formation of $H_2$ and $Cl_2$ respectively at the cathode and the anode if an acqueous solution of NaCl is present in the ink. The gaseous bubbles 21 provide the internal pressure required to eject an ink droplet toward the paper, as illustrated in FIG. 4.

A similar technique consists in applying an AC, rather than DC, voltage to the electrodes during a printing cycle. As a result, both products of the electrolysis reactions are now formed at each electrode. If these two products react explosively, as for example in the case of $H_2$ and $0_2$ obtained in the electrolysis of aceqeous Sulfuric Acid, the resulting micro-explosion provides the energy required to propel the upper liquid ink to the paper. The application of an AC current, rather than DC, is also advantageous because it prevents the eventual electrode dissolution during the electrolysis process.

Instead of partially or completely vapourizing the ink, it can be caused to flow out of the orifices by reducing the surface tension. Thus, considering FIG. 1, if the heating element 13 heats the ink to reduce the surface tension at 14 ink will flow out of the orifice 12 across to the paper 16. In this system the static pressure in the reservoir is slightly less than the surface tension at the ink surface. The ink will assume a convex meniscus shape, with the radius of curvature of the meniscus decreasing, that is the curvature increasing, until an equilibrium is reached between surface tension and hydrostatic pressure. The surface tension increases with a decrease in the radius of curvature of the meniscus, reaching a maximum when the radius of curvature is equal to the radius of the orifice. By heating the ink in the orifice, the surface tension coefficient decreases (for example it decreases about 20% for water when the temperature is raised from ambient to 100° C.) and the meniscus curvature increases to reach a new equilibrium position, eventually reaching the paper surface and printing a spot. Best results are obtained when the equilibrium surface tension at ambient temperature is near to the maximum, so that when heat is applied the surface tension is lower than the hydrostatic pressure even at its maximum. In this case, there is no equilibrium position and ink flows freely to the paper when thermally activated. For this arrangement, it is advantageous to apply a fluctuating pressure to the ink, as by the supply pump, or alternatively, as illustrated in FIG. 3, by a vibrator 28 which can be mounted on a wall of the reservoir. The vibrator can have a diaphragm in contact with the ink, the diaphragm being pulsed to produce the fluctuating pressure. Electrical power is supplied to the vibrator via leads 29. The current pulse to the resistor is coincident with the maximum pressure. The subsequent minimum pressure will assist in stopping ink overflowing when the heating pulse is cut. The outer surface of the reservoir should preferably be coated with a hydrophobic material to prevent ink expanding laterally rather than across the gap to the paper.

While the orifices have been illustrated, in FIG. 3, as extending in a line, orifices can be arranged in other predetermined patterns, for example to print alphanumerica character by character. According to requirements heating of the ink can occur at one or more orifices at a time.

What is claimed is:

1. A thermally activated liquid ink printer comprising:

a reservoir for holding liquid ink;

a plurality of orifices extending through a wall of the reservoir;

means for supplying ink to the reservoir at a predetermined pressure to fill each of the orifices to an outer end thereof, the orifice outer ends located at an outer surface of the reservoir wall and each orifice outer end being of a dimension such that surface tension forces on the ink balance said predetermined pressure to retain the liquid ink within the reservoir;

means for positioning paper adjacent to the outer ends of the orifices;

means for moving the paper past the orifice outer ends; and an electrical resistive heater surrounding each orifice at its outer end, the heater operable on receiving an energizing pulse to heat ink at the outer end of its associated orifice to rapidly reduce the surface tension of the ink in the outer end of the orifice and thereby cause the heated ink to issue from the orifice outer end under the influence of said predetermined pressure and be deposited on the paper, said heated ink being replaced in the orifice by unheated ink subject to surface tension forces balancing said predetermined pressure whereby abruptly to terminate issue of ink form the orifice.

2. A thermally activated liquid ink printer as claimed in claim 1, in which said orifices are arrayed along a line extending transversely relative to a direction of movement of said paper.

3. Apparatus as claimed in claim 1, or 2, including means for fluctuating the predetermined pressure of ink in said reservoir.

4. A method of printing comprising delivering ink from a reservoir thereof to fill a plurality of capillary orifices in a wall bounding the reservoir;

regulating ink pressure whereby to maintain each of the orifices filled to an outer end thereof, the ink retained at the outer ends of the orifices by surface tension forces balancing the regulated ink pressure;

mounting paper adjacent the orifice outer ends to receive ink issuing therefrom;

electrical pulse resistively heating the ink at an outer end of selected orifices to rapidly reduce the surface tension of the ink at such orifices to an extent at which said predetermined pressure exceeds pressure created by surface tension whereby the heated ink issues from said selected orifices onto the paper, said heated ink being replaced in the selected orifices on termination of a heating pulse by unheated ink subject to surface tension forces balancing the predetermined pressure whereby abruptly to terminate issue of ink from the selected orifices.

5. A method as claimed in claim 4, further including applying a fluctuating pressure to said ink in said reservoir, an increase in pressure being coincident with application of electrical resistive heating pulses.

* * * * *